US007011195B1

(12) United States Patent
Kho

(10) Patent No.: US 7,011,195 B1
(45) Date of Patent: Mar. 14, 2006

(54) EASY PULLING HEAVY LUGGAGE

(76) Inventor: Dick T. Kho, 421 Frankfurt Ave., West Covina, CA (US) 91792-2809

( * ) Notice: Subject to any disclaimer, the term of this patent is extended or adjusted under 35 U.S.C. 154(b) by 0 days.

(21) Appl. No.: 11/076,337

(22) Filed: Mar. 9, 2005

Related U.S. Application Data

(60) Provisional application No. 60/630,139, filed on Nov. 22, 2004.

(51) Int. Cl.
*A45C 5/00* (2006.01)

(52) U.S. Cl. ..... 190/18 A; 190/115

(58) Field of Classification Search ..... 190/18 A, 190/115
See application file for complete search history.

(56) References Cited

U.S. PATENT DOCUMENTS 4,299,313 A * 11/1981 Null ..... 190/18 A
4,561,526 A * 12/1985 Winter et al. ..... 190/115
5,075,925 A * 12/1991 Maloney ..... 16/113.1
5,394,965 A * 3/1995 Kho ..... 190/115
6,148,971 A * 11/2000 Kho ..... 190/18 A

* cited by examiner

*Primary Examiner*—Tri M. Mai
(74) *Attorney, Agent, or Firm*—Monty Koslover

(57) ABSTRACT

An improved suitcase base and an improved pulling handle for use in a soft-sided suitcase and a hard-sided suitcase, giving the luggage, easy pulling characteristics. The base is nearly symmetrical in shape, with a V-shaped bottom wall forming an obtuse angle, which creates good ground clearance for the suitcase bottom under all conditions of towing over flat or uneven surfaces. Provision is made for securely latching the pulling handle while stored, and for quick, easy release from storage for pulling handle deployment. A duffle bag luggage carrier that incorporates the improved base, is also described. The improved base and quick-release pulling handle are easily adaptable to different styled soft-sided and hard-sided suitcases, and for non-suitcase luggage carriers.

6 Claims, 8 Drawing Sheets

EASY PULLING HEAVY LUGGAGE

This application claims the benefit of Provisional Application No. 60/630,139, filed Nov. 22, 2004.

BACKGROUND OF THE INVENTION

1. Field of the Invention

This invention relates to luggage and in particular, to suitcases having attached wheels and a handle for pulling.

2. Background

U.S. Pat. No. 6,148,971, "Easily Pullable Suitcase" by the present inventor Dick T. Kho, issued on Nov. 21, 2000. The patent described a soft-sided suitcase and a hard-sided suitcase that can be towed, using an attached pivoted pulling handle, on four wheels which consist of two main wheels and two forward located caster wheels, or towed on the main wheels alone. Provision is made for the pulling handle to be fixed rigidly at a small upward angle to ease towing on the main wheels. This requires the front end of the suitcase to be lifted while towing and would reduce ground clearance at the back end of the suitcase. To avoid this possible problem particularly on uneven ground, the bottom wall of the rear half of the suitcase side was raised at an angle of about 17 degrees with the plane of the front half bottom wall. This resulted in the location of the main wheels being moved to a new gravity center that was now forward from the normal center half-way point. In addition, it meant that the suitcase front end was now longer than the back end.

The above patented suitcase configuration has done reasonably well in acceptance by travelers, and can indeed be towed easily on all four wheels or on two main wheels. However, some ongoing low priority problems requiring a solution and improvement were brought to the attention of the inventor by manufacturers and others.

First, due to the non-symmetrical shape of the suitcase base, for a soft-sided suitcase, the suitcase frame also had to be specially made non-symmetrical to fit the base, and resulted in extra cost. It also severely restricted the suitcase style shape to that described in the patent.

For a hard-sided suitcase, the required placement of the main wheels and the angled back portion, resulted in awkward hinging of the suitcase cover, and restricting the suitcase shape and style. A base design that was approximately symmetrical and met the required ground clearance requirements for pulling on two main wheels or on all the wheels, would then be welcomed, particularly by manufacturers.

Second, users found that sometimes, the pulling handle did not store securely in the guide plate on the suitcase. Also, deployment of the pulling handle to a fixed handle position often took significant time to complete. A more secure pulling handle storage and a quick release from storage would be appreciated.

There is thus, a need for an improved suitcase base that would meet the requirement for easy towing suitcase while permitting variation in suitcase design, and an improved pulling handle that gives a traveler greater ease of use.

SUMMARY OF THE INVENTION

The invention is an improved suitcase base and an improved pulling handle for incorporation in a soft-sided suitcase and a hard-sided suitcase, and maintaining the suitcase easy pulling characteristics. The base is made approximately symmetrical in shape, with a V-shaped bottom wall forming an obtuse angle sufficient to give good clearance for the suitcase bottom, whether towed on the main wheels alone, or on all the wheels. This base shape permits the invention base to be used for a number of different styled soft-sided and hard-sided suitcases, a well as for non-suitcase luggage carriers. The improved base is also used to give an easy pulling characteristic to a duffel bag luggage carrier. Provision is made for securely latching the pulling handle while stored and for quick, easy release from storage when a user needs to deploy the pulling handle.

Accordingly, it is a prime object of the present invention to improve the suitcase base and pulling handle, so that a suitcase can be pulled easily without undue strain on the hand or arm of a user over flat or uneven ground, whether on the main wheels or on all the wheels.

Another object of the present invention is to improve the pulling handle to store the handle securely and to quickly and easily release the handle from storage when a user needs to deploy the handle for towing.

An advantage of the invention over presently available towable suitcases is its adaptability to soft-sided and hard-sided suitcases having a number of different styles and shapes.

Further objects and advantages of the invention will be apparent from studying the following portion of the specification, the claims and the attached drawings.

DESCRIPTION OF THE PREFERRED AND ALTERNATE EMBODIMENTS

The invention is an improvement to an easy pulling luggage base configuration plus an improved quick-release pulling handle, which can be used for several styles of soft-sided and hard-sided suitcases, with minor modification. The invention base configuration, with an addition, can also be used as a truck for pulling luggage such as a duffel bag. This invention suitcase base and quick-release pulling handle are described herein in detail, and shown incorporated in a typical soft-sided suitcase and hard-sided suitcase.

Figure 1:
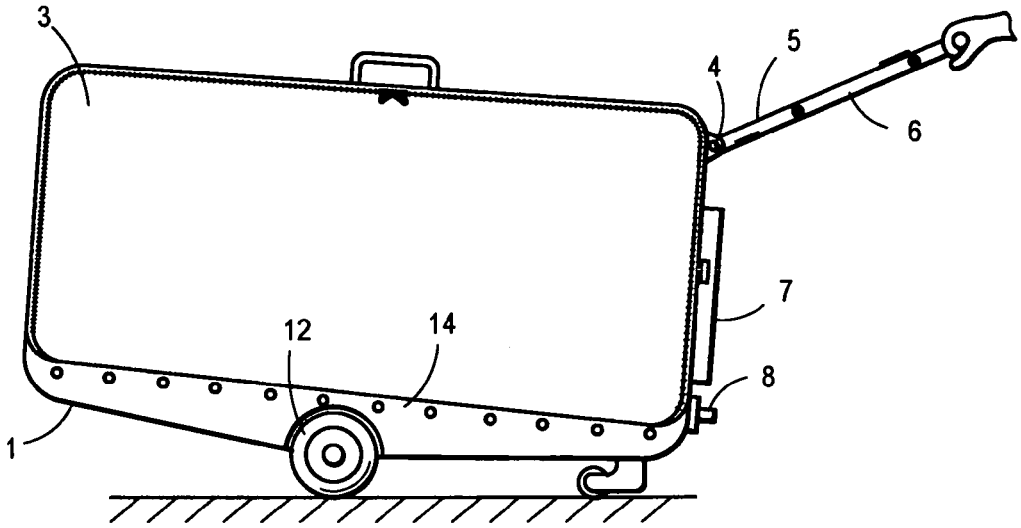
FIGS. 1 and 2 are respectively, a front side elevation view and a back side elevation view of a soft-sided suitcase which incorporates a suitcase base and pulling handle according to the present invention.
Figure 2:
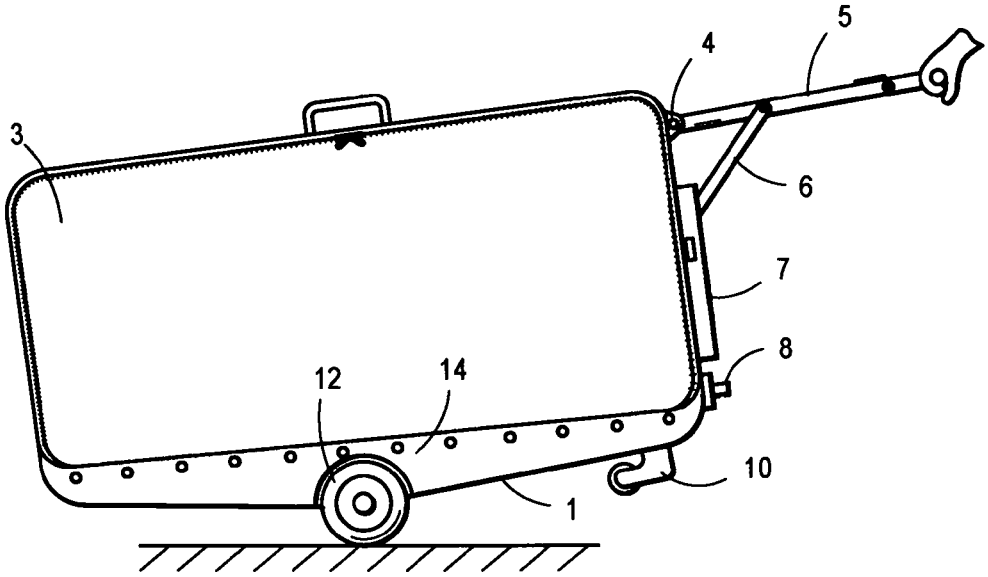

Referring particularly to FIGS. 1 and 2, there are shown two side views of a soft-sided suitcase according to the present invention, being pulled over a flat surface.

The top portion of a softsided suitcase consists of a rectangular, inverted U shaped metal frame, that is covered with a soft, fabric material 3. The frame and fabric material cover 3 are fastened by rivets 14 to a base 1. The base 1 is made of a hard rigid material which is supported on two sets of wheels, and includes a quick-release pulling handle 5 that is fastened by a pivot pin to a pivot mount 4 fixed near the top of the suitcase at a front end.

A pair of struts 6 that are held by a guide plate 7, hold the pulling handle 5 rigidly when a user wants to lift the front end of the suitcase as shown in FIG. 2. The guide plate 7 holds the pulling handle 5 against the suitcase end for storing, while a latch plate 8 locks the pulling handle in place until it is manually released.

The base bottom wall has an open V shape forming an obtuse angle of about 163 degrees, with two main wheels 12 centered, one at each side, balancing the suitcase contents and making it easier to pull than an unbalanced suitcase, particularly over uneven ground. A swiveling caster wheel 10 is provided attached under the base bottom wall adjacent to the front end, to ease turning corners while pulling the suitcase.

Figure 3:
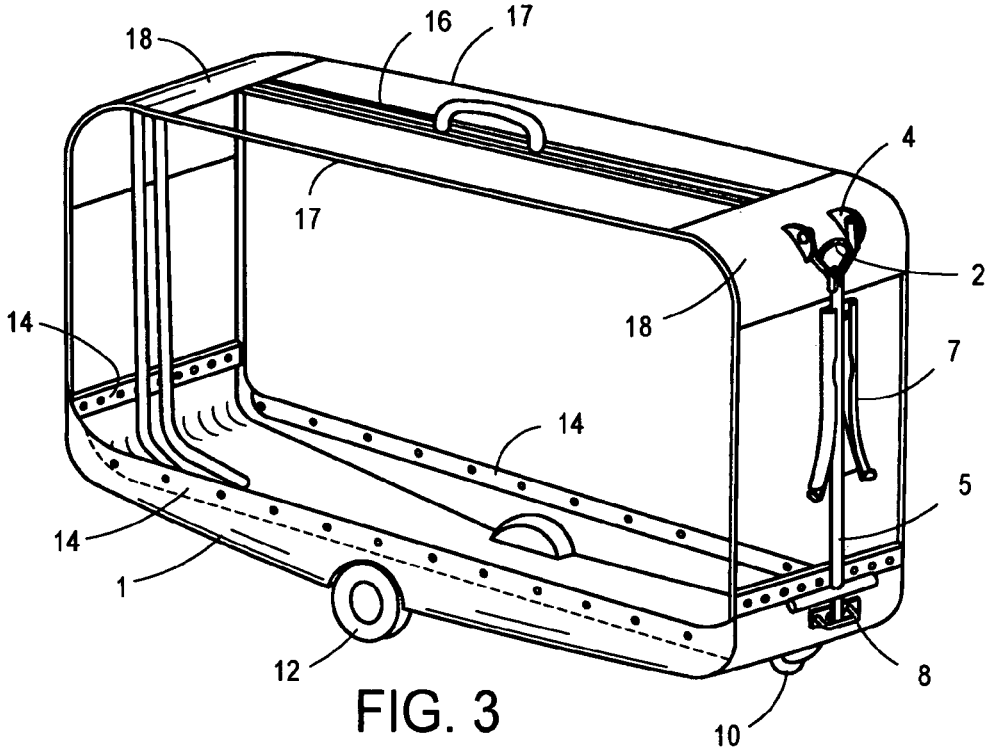
FIG. 3 is a perspective view of a soft-sided suitcase, according to the present invention, particularly showing a metal frame attached to a suitcase base, and a pulling handle mounted and stowed at the forward end of the frame.

Refer now to FIG. 3 which is a perspective view of a soft-sided suitcase according to the present invention, but omitting the fabric cover to show detail of the suitcase interior. The base 1 interior is shown to be a shallow, elongate trough, with a floor that slopes evenly down to a mid-point. The two main wheels 12 are supported by an axle that is fastened to the underside of the base at the mid-point. Thus, ordinary packing of the suitcase by a user should result in a balanced weight on the main wheels for easy pulling. This compares with the soft-sided suitcase described in earlier U.S. Pat. No. 6,148,971 by this inventor, where the front end of the suit-case was made deeper than the back end, and the main wheels were located at a calculated center of gravity point rather than being centered between the suitcase ends.

The frame, which is typical for soft-sided suitcases, is constructed using at least two metal center beams, two metal side beams 17, and two top corner plates 18 to stiffen the beams. The frame is symmetrical, with both ends identical, and is joined to the base 1 by rivets or by other fasteners.

The soft fabric cover 3 covering the frame is fastened to the frame beams, and is joined by rivet strips 14 to the base 1.

It should be pointed out that the frame and cover housing shape need not be perfectly rectangular and have flat sides. It may be instead, somewhat curved for a particular style, and still be able to fit well to the base 1. The only fixed frame requirement is that the housing (frame) front end be mostly flat to support the pulling-handle 5.

The pulling handle 5 is an assembly of a long, hollow tube 24 to which a handle grip 25 is attached at one end, and at a distal end, two curved mounting strips 26 which form a U shape for attaching the pulling handle to the suitcase side. A pair of struts 6 that pivot on the tube 24 sides, are included as well as an internal quick-release latching mechanism having an attached pull ring 2 at one end and a latchpin 36 at the distal end.

As shown in FIG. 3, the pulling handle mounts on a pivot mount 4 to the front side of the suitcase, and is stored and gripped by a long guide plate 7. The latchpin 36 is locked in a latch plate 8 which is mounted on the base 1. Pulling the ring 2, will release the latchpin from the latch plate 8 and allow a user to move the pulling handle 5 out of the stored position.

Figure 4A:
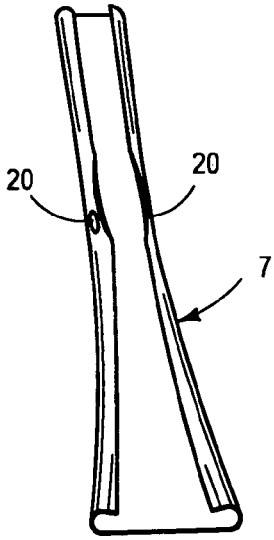
FIG. 4A is a perspective view of a strutpin guide that holds the pulling handle to the frame when the handle is stored.
Figure 4B:
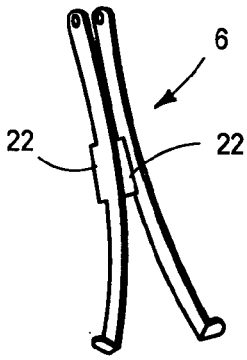
FIG. 4B is a perspective view of the pair of struts that are attached to the pulling handle.
Figure 4C:
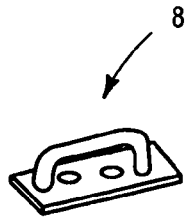
FIG. 4C is a perspective view of a latch which is engaged by a latchpin which normally extends from the handle grip on the pulling handle.

FIGS. 4A, 4B and 4C are respectively, perspective views of a guide plate 7, a pair of struts 6 and a latch plate 8. The guide plate 7 is made long and flared at its lower end to guide the hanging ends of the struts 6 inward. Slots 20 in a notched area of the guide plate walls, catch the struts ends when the pulling handle is being moved from an open pulling position as in FIG. 1, to a fixed position shown in FIG. 2.

The guide plate 7 is shaped and sized particularly to store a pulling handle 5 with its struts 6 alongside the handle tube, flat against the guide plate and struts gripped gently by the guide plate side walls. This makes it easy for a traveler to shift the pulling handle out of the guide plate for deployment after the handle has been unlatched.

The struts 6 are made of a springy metal and are normally bent outward, with fastening lips at one end and projecting portions 22 along the strut length to aid in guiding the struts.

Figure 5:
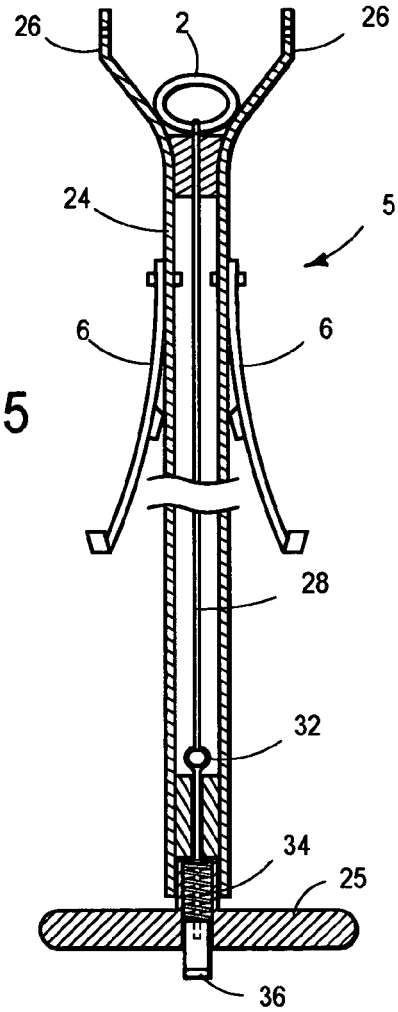
FIG. 5 is a partial, cutaway view of the pulling handle, particularly showing a spring pressure mechanism that extends a latch pin outward and a ring pull cord to pull the latch pin inward.
Figure 6:
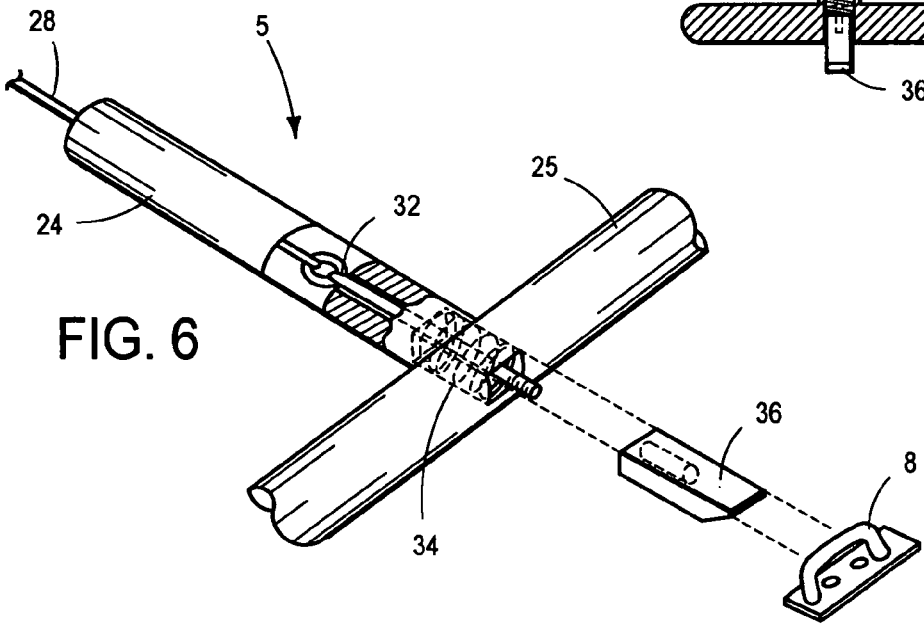
FIG. 6 is a partial, exploded view of the latching, unlatching mechanism in the pulling handle.

Refer now to FIGS. 5 and 6, which particularly show the quick release latching mechanism contained in the pulling handle 5. A metal ring 2 is located at the pivoting end of the handle and is fastened to an end of a wire cord 28 that passes through a top plug in the tube 24, continues through the tube length and is fastened to an end of a metal rod 32. The rod 32, passes through a second plug which is located in the tube 24, adjacent to the lower tube end, and projects into an opening in the handle grip 25. A metal washer and a helical compression spring 34 are placed over the projecting portion of the rod 32 and a latchpin 36 is fastened to the end of the rod. In the normal position, the tip of the latch pin 36 protrudes a little from the handle grip 25, and if stored, would engage the latch plate 8. A pull on the ring 2 causes the latchpin 36 to be withdrawn into the handle and the spring 34 to be compressed. At this time, the pulling handle is unlatched and can be moved for deployment. Releasing the ring 2 returns the mechanism to the normal position. Storing the pulling handle is done by simply swinging the pulling handle downwards and pushing the handle until the latchpin 36 clicks into the latch plate 8.

Thus, release of the pulling handle from a stored position for deployment is quick and easy to perform, as is storage.

The suitcase base 1 may be formed from a hard plastic material, a hard composite material or even a metal material. All the component parts of the pulling handle 5 and its mounts, guide and latch plate are made of metal or plastic.

Figure 7:
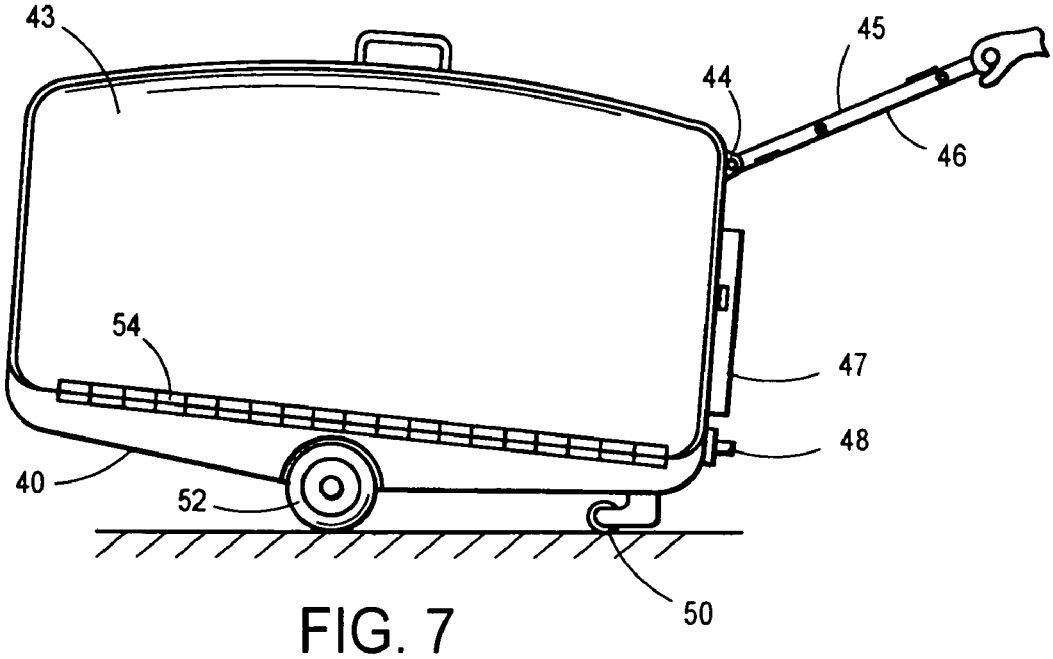
FIGS. 7 and 8 are respectively, a front side elevation view and a back side elevation view of a hard-sided suitcase which incorporates a suitcase base and pulling handle according to the present invention.
Figure 8:
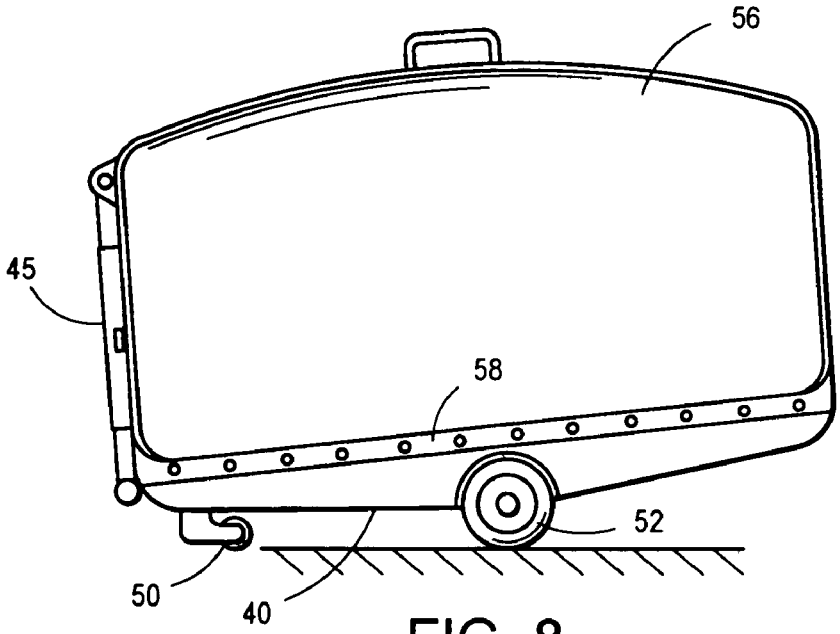

Refer now to FIGS. 7 and 8 which are respectively, a lid front side elevation view and a back side elevation view of a hard-sided suitcase which incorporates a suitcase base and pulling handle according to the present invention.

The base 40 is the same, except for a minor addition of a hinge part, as that described in the forgoing paragraphs for a soft-sided suitcase, as are the main wheels 52 and the forward mounted caster wheel 50. The pulling handle 45, pivot mount 44, guide plate 47 and latch plate 48 are also identical to those named parts described earlier for use with a soft-sided suitcase.

In FIGS. 7 and 8, and in the remaining hard-side suitcase drawings (FIGS. 9 and 10), a hard-sided suitcase is represented as incorporating no frame, but rather having a hard shell 56 which is self-supporting, and attached directly to the base 40. However, a frame and an envelope made of hard panels would attach to the base in the same manner.

As shown in FIG. 7, the shell 56 has been cut on one side, to form a separate lid 43 which is fastened by a hinge 54 to one side of the base 40. Means are provided for opening the lid 43. In FIG. 8, the back side of the shell 56 is shown as being attached with a riveted strip 58 to the base 40.

Since the shape of the base 40 is nearly symmetrical, seen from the side, and the main wheels 12 are mounted on an axle fastened transversely across the base underside, instead of being inset in the sides; there is much more variation possible in the design of the lid 43 and placement of the lid hinge. This was not so for the base configuration described in U.S. Pat. No. 6,148,971, and represents an improvement, making the invention base more universal in application to suitcases of all styles.

Figure 9:
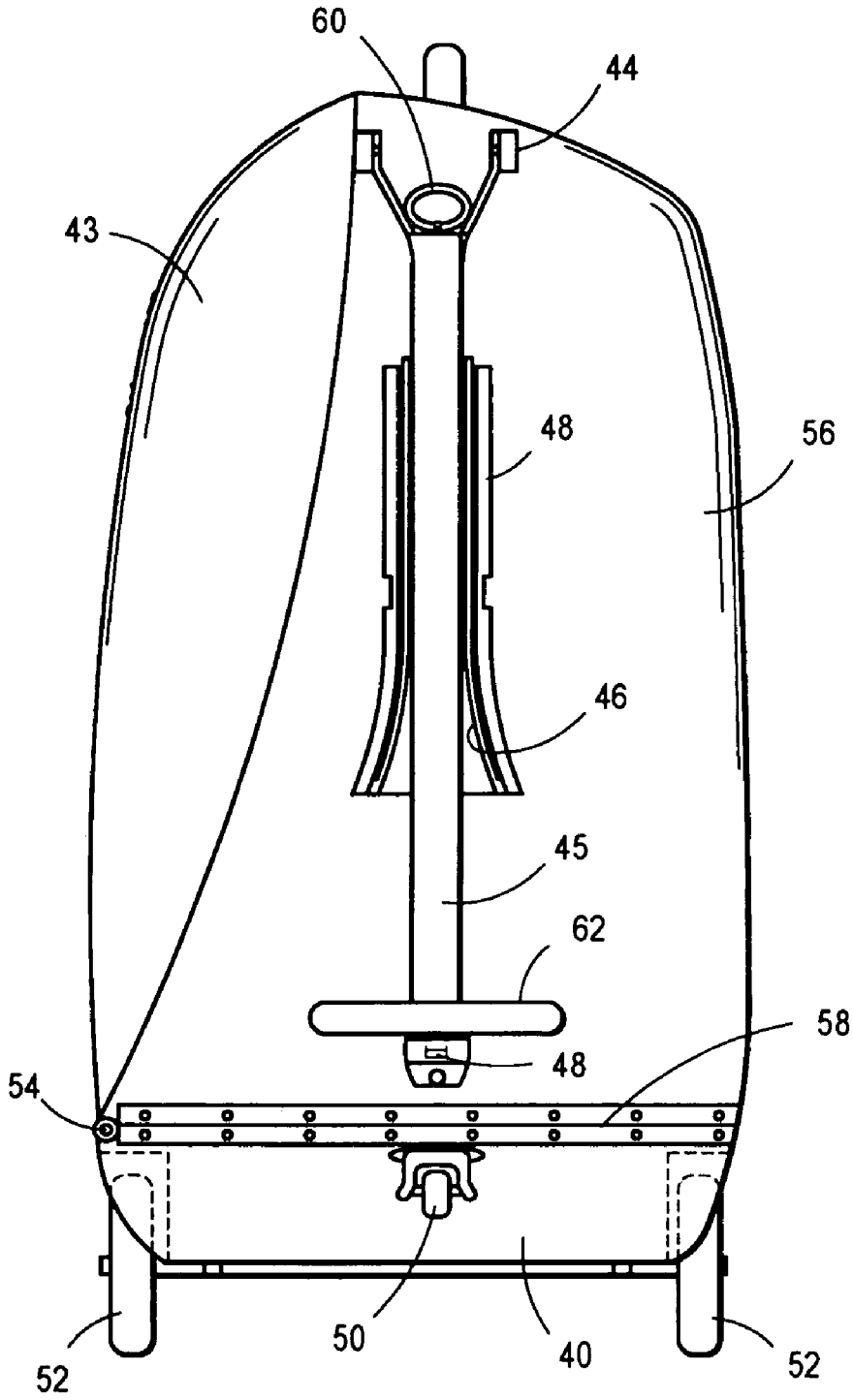
FIG. 9 is a forward end elevation view of a hard-sided suitcase, particularly showing a hinged lid.

This matter is exemplified by FIG. 9, which shows the front end of the suitcase, particularly showing the lid 43 cut away from the shell 56 on one side and fastened by a hinge 54 to the base 40.

The pulling handle 45 is pivotably mounted on mounts 44 near to the top of the shell and a pull ring 60 is at the top of the handle. The handle is depicted in a stored position, with its attached struts 46 nested inside the side walls of the guide plate 48, and the handle latchpin, extending out of the handle grip 62 and into a latch plate 50. Both the front end and back end of the shell are fastened to the base with a rivet strip 58.

Figure 10:
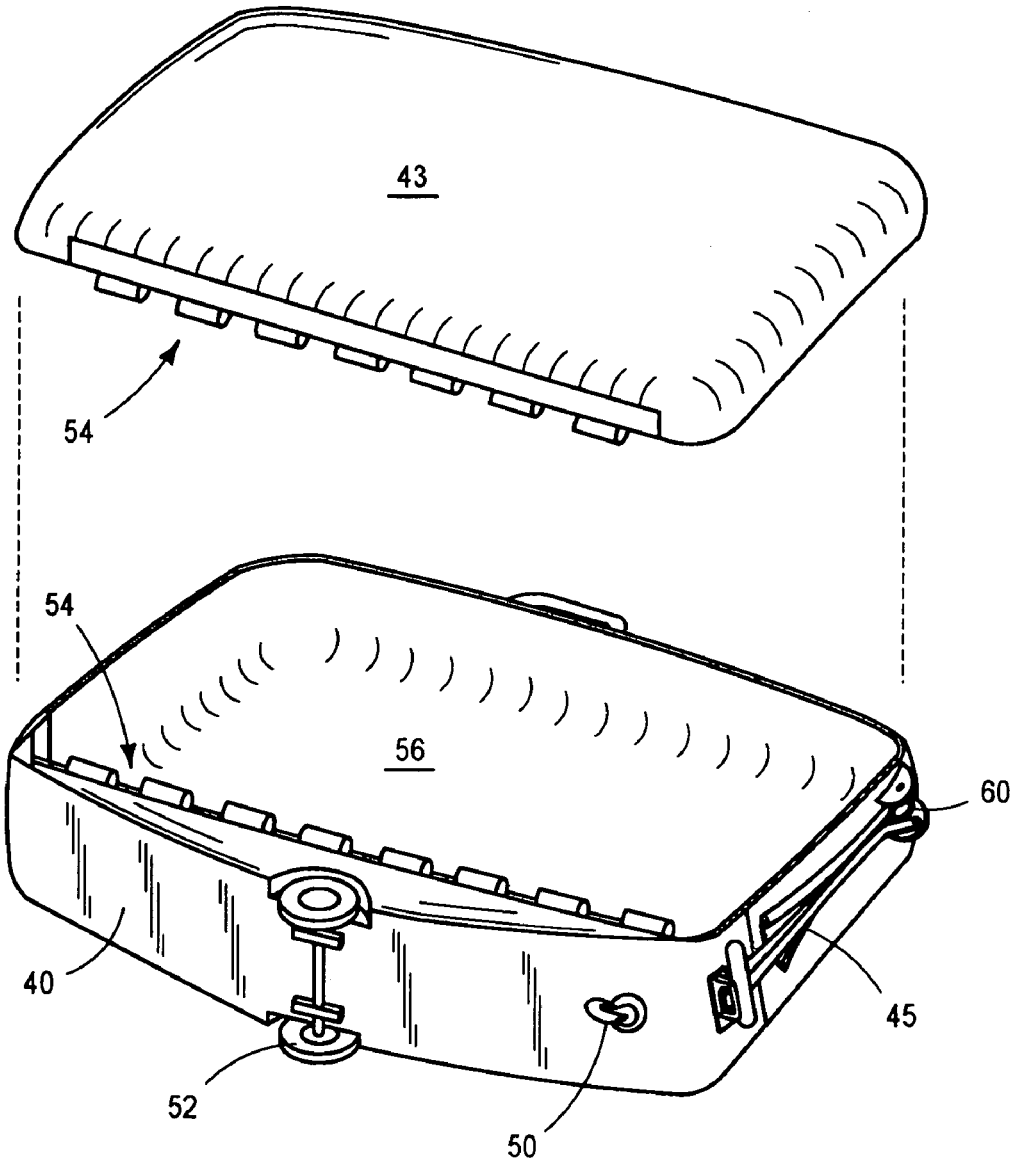
FIG. 10 is an exploded view of a hard-sided suitcase, particularly showing the lid separated from the case shell which is fastened to the suitcase base.

The views in FIG. 10, showing the lid 43 separated from the shell 56 which is joined to the base 40, are offered as a further clarification of how a hard-sided suitcase using the invention improved base, may be constructed.

As stated in the foregoing description of the soft-sided suitcase configuration, the suitcase base 40 may be formed from a hard plastic material, a hard composite material or even a metal material. Also, all the component parts of the pulling handle 45 and its mounts, guide and latch plate are made of metal or plastic.

After using the invention improved base configuration and the improved pulling handle for soft-sided and hard-sided suitcases, consideration was given to whether the improved base configuration could be used for another type of luggage or luggage carrier. The conclusion was that the invention base could indeed be used with an attached front end panel, and serve as a truck for a duffle bag carrier.

Figure 11:
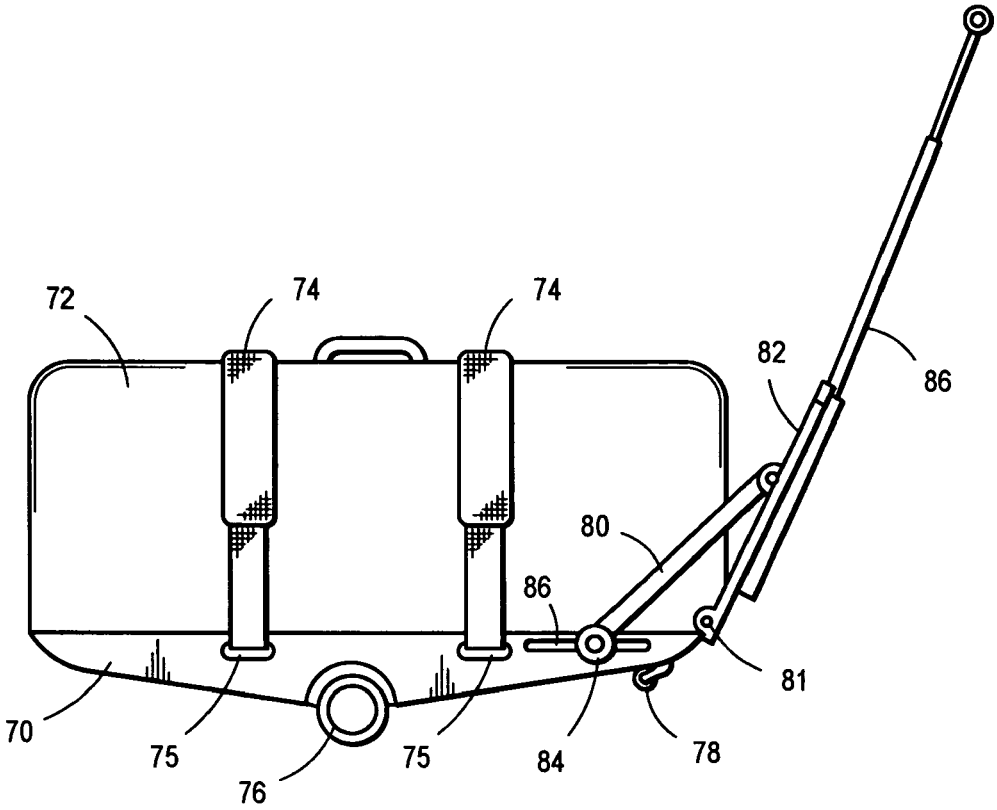
FIG. 11 is a side elevation view of a duffle bag being transported on a duffle bag truck according to the present invention.

A side elevation view of a duffle bag carrier, using the invention base as a truck 70, and carrying a duffle bag 72, is shown in FIG. 11. The truck 70 includes two slits 75 on both it's parallel side walls, for straps 74 which fasten a duffle bag 72 to the top of the truck 70. A pair of main wheels 76 are mounted on an axle transversely to the side walls that is fastened to the underside of the truck. A castered wheel 78 is swivel mounted to the underside of the truck 70, adjacent to the front end. A wide, rigid end plate 82 is pivotally attached to the front end of the truck 70 and carries an attached collapsible pulling handle 86. As shown in FIG. 11, the end plate 82 is fixed at an angle of about 120 deg. with the plane of the truck 70. This is a comfortable angle for hand pulling the truck using the pulling handle 86.

Figure 12:
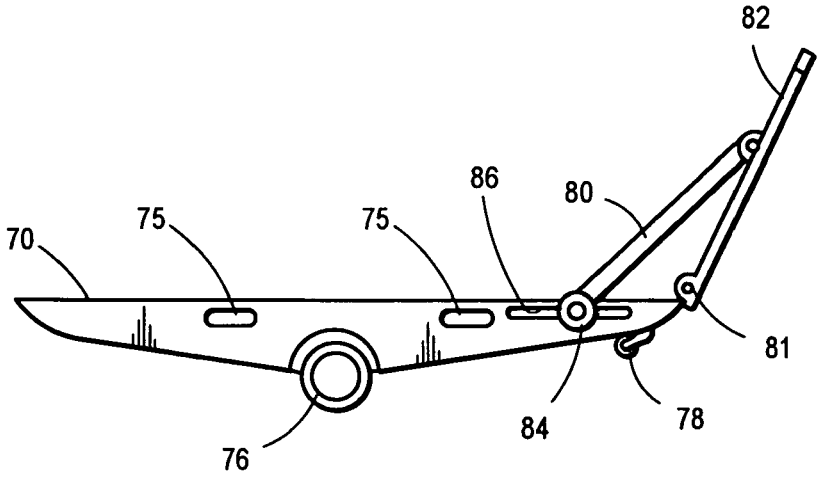
FIG. 12 is a side elevation view of a duffle bag truck, showing an adjustable angle, forward end plate.

Refer now to FIG. 12 which is a side elevation view of the invention duffel bag carrier without the duffel bag and fastening straps. A means for adjusting the angle of the end plate 82 and fixing it in place is included. This means consists of a long slot 86 in both sides of the truck adjacent to the forward end, and two metal struts 80, one on each side, with a fastening knob 84 at one end of the strut that slides in the slot 86, and is fastened pivotally at a distal end to the end plate 82. The parallel slots 86 are located and sized in length to allow the angle of the end plate 82 to be varied and fixed by the knob 84 at any angle from about 90 deg. to about 130 deg. The end plate 82 would probably be fixed at 90 deg. for storage purposes.

Figure 13:
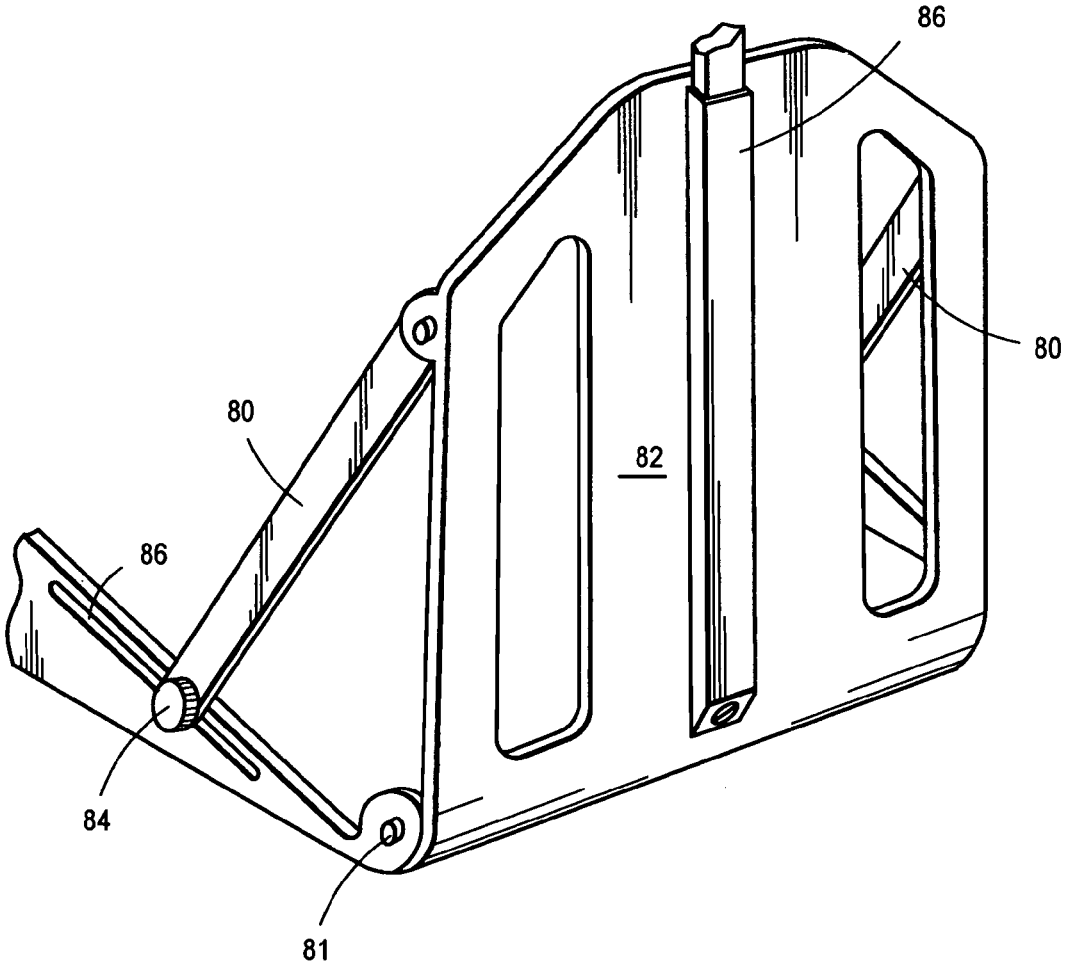
FIG. 13 is a perspective view of the truck forward end plate, particularly showing the angle adjustment mechanism.

The above described angle adjustment means is shown more clearly in FIG. 13, which is a partial, enlarged perspective view of the end plate 82 and its pivot mount 81 attachments to the truck 70. The lower portion of a telescoping pulling handle 86 is shown attached to the front side of the end plate 82.

Regarding materials used in fabricating the duffle bag carrier; the truck 70 and the end plate 82 may be formed from a hard plastic, a hard composite, or a metal material.

In the foregoing descriptions, it has been demonstrated that the improved configuration base is adaptable to different types and styles of suitcases and a duffel bag or similar carrier.

The invention base and quick-release pulling handle, together give a traveler more ease in packing a suitcase, and in deploying the pulling handle, than is available for the previous suitcase design.

Manufacturers are offered a simplicity of design, with attendant lower costs, and more leeway in adapting styles which involve a suitcase shape.

From the foregoing description, it is clear that the preferred and alternate embodiments of a suitcase and luggage carrier achieve the objects of the present invention. Various modifications may be apparent to those skilled in the art. These modifications are considered to be within the scope and spirit of the present invention and are encompassed thereby.

Having described the invention, what is claimed is:

1. In a soft-sided suitcase, said suitcase including a rigid metal frame and a soft fabric material which is fastened to said frame at a top and sides, forming a frame enclosure with an open bottom; said frame enclosure having a sliding fastener openable portion on one side that serves as a cover;

a suitcase base and pulling handle comprising:

(a) a base made of a hard, rigid material, formed in a tray-like trough; said base having an open top, elongate opposing parallel planar side walls, a bottom wall, a planar front end wall and an opposing rear end wall; said bottom wall having a V shape forming an obtuse angle of approximately 163 degrees; said base including:

a pair of main wheels, that are rotatably mounted transversely to said side walls on an axle and fastened to an underside of said bottom wall at a proximate midway point between said front end wall and said rear end wall;

a caster wheel which is swivel mounted on said bottom wall adjacent to said front end wall; and a first latch plate which is mounted and fastened to said front end wall of said base on an outer surface midway between said side walls;

said frame enclosure being placed vertically and fastened at ends of said open bottom to said open top of said base;

(b) a quick-release pulling handle that is pivotably mounted on a side of said frame enclosure which is fastened to said front end wall of said base; said pulling handle being constructed with an elongate, hollow metal tube that includes plugs which are fastened in said tube, inset near each end, said plugs having an axial bore cut through their length, a handlebar which is attached to one end of said tube at an angle of 90 deg. to said tube, and two curved metal handle mounting strips that are fastened to opposing edges of a distal end of said tube, defining a "U" shaped mounting member for pivotally mounting said pulling handle; said pulling handle including a first means for latching and quickly releasing said pulling handle from a stored and latched position; and (c) second means for fixing said pulling handle rigidly in place to facilitate lifting the suitcase at a front end while pulling said suitcase.

2. The suitcase base and pulling handle as defined in claim 1, wherein said first means for latching and quickly releasing said pulling handle from a stored and latched position includes:

a metal ring that is located between said handle mounting strips, a spring latch mechanism that is disposed axially inside said tube of said handle and through a center hole in said handlebar, and a wire cord connecting said ring to an end of said mechanism inside said tube; said spring latch mechanism comprising a metal rod having a tie-ring on one end and a threaded distal end; a helical compression spring, a metal washer and a latchpin, said rod being disposed in said axial bore of said second plug, with said threaded distal end extending beyond the plug, said washer and said spring being axially disposed on said rod and said latchpin screwed on to said rod at said threaded end; said latchpin normally extending beyond said handlebar and ready to be engaged by said first latch plate on said base and thereby latching said pulling handle; said pulling handle being released by pulling on said ring which is located at one end of said pulling handle and withdrawing said latchpin from said first latch plate, releasing said pulling handle and making ready for handle deployment.

3. The suitcase base and pulling handle as defined in claim 1, wherein said second means for fixing said pulling handle rigidly in place includes two elongate strut members, pivotably fastened opposing each other at one end to said pulling handle tube, and an elongate guide plate which is fastened to a side of said frame enclosure which is fastened to said front wall of said base, below the pivoting end of said pulling handle; the distal portion and distal ends of said strut members being permanently bent outwards and springy, forming a wide opening between the sides of said strut members at their distal ends, said distal ends of said strut members each including a portion permanently bent at an acute angle outward, forming fastening lips; said guide plate shaped having a wide flared lower end a narrow upper end, with side walls folded inwards having a U-shaped cross-section, sufficient to store said pulling handle against the front end of said suitcase and to catch and hold the sides and ends of said strut members when the pulling handle is deployed, said guide plate including a notch and slot in both side edges to catch and hold said fastening lips of said strut members, thereby fixing said pulling handle rigidly in place when the pulling handle is deployed.

4. The suitcase base and pulling handle as defined in claim 1, wherein said base is made of a hard plastic material.

5. The suitcase base and pulling handle as defined in claim 1, wherein said base is fabricated from a composite material.

6. The suitcase base and pulling handle as defined in claim 1, wherein said base is fabricated from a metal material.

* * * * *